US009889496B2

(12) United States Patent
Ochiai

(10) Patent No.: US 9,889,496 B2
(45) Date of Patent: Feb. 13, 2018

(54) METHOD FOR MANUFACTURING METAL FITTING, METHOD FOR MANUFACTURING SPARK PLUG, AND METHOD FOR MANUFACTURING SENSOR

(71) Applicant: NGK SPARK PLUG CO., LTD., Nagoya-shi, Aichi (JP)

(72) Inventor: Satoru Ochiai, Nagakute (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/301,088

(22) PCT Filed: Jun. 22, 2015

(86) PCT No.: PCT/JP2015/003113
§ 371 (c)(1),
(2) Date: Sep. 30, 2016

(87) PCT Pub. No.: WO2015/198581
PCT Pub. Date: Dec. 30, 2015

(65) Prior Publication Data

US 2017/0021407 A1 Jan. 26, 2017

(30) Foreign Application Priority Data

Jun. 27, 2014 (JP) ..... 2014-132790

(51) Int. Cl.
*B21K 21/08* (2006.01)
*H01T 21/02* (2006.01)
*B21J 5/06* (2006.01)

(52) U.S. Cl.
CPC ..... *B21K 21/08* (2013.01); *B21J 5/06* (2013.01); *H01T 21/02* (2013.01)

(58) Field of Classification Search
CPC . B21K 21/08; B21K 21/10; B21J 5/06; H01T 21/00
See application file for complete search history.

(56) References Cited

U.S. PATENT DOCUMENTS 4,352,283 A 10/1982 Bailey ..... 72/354
2003/0005740 A1* 1/2003 Tanaka ..... B21K 21/08 72/355.6

(Continued)

FOREIGN PATENT DOCUMENTS

JP H01-16693 A 1/1995 ..... B21J 5/06
JP H07-016693 A 1/1995 ..... B21J 5/06

(Continued)

OTHER PUBLICATIONS

International Search Report issued in corresponding International Patent Application No. PCT/JP2015/003113, dated Sep. 15, 2015.

(Continued)

*Primary Examiner* — Anne Hines
(74) *Attorney, Agent, or Firm* — Kusner & Jaffe

(57) ABSTRACT

A method of manufacturing a metal fitting having a tool engagement portion engageable with a tool. The manufacturing method includes a cold forging process, wherein the cold forging process includes: a step (a) of forming a body portion having a first maximum length and a butt portion being continuous to the body portion and having a second maximum length larger than the first maximum length; and a step (b) of drawing at least a part of the butt portion in the axis direction, thereby forming the tool engagement portion.

7 Claims, 10 Drawing Sheets

(56) References Cited

U.S. PATENT DOCUMENTS

| | | | | |
|---|---|---|---|---|
| 2003/0196468 | A1 | 10/2003 | Ando et al. | 72/353.2 |
| 2009/0127997 | A1* | 5/2009 | Kameda | H01T 13/32 313/141 |
| 2009/0140624 | A1* | 6/2009 | Kameda | H01T 21/02 313/141 |
| 2010/0264802 | A1* | 10/2010 | Tanaka | B22F 3/162 313/141 |
| 2011/0210659 | A1* | 9/2011 | Suzuki | H01T 13/32 313/141 |
| 2011/0215702 | A1* | 9/2011 | Kameda | H01T 13/32 313/141 |

FOREIGN PATENT DOCUMENTS

| | | | | |
|---|---|---|---|---|
| JP | 2002-011543 | A | 1/2002 | B21J 13/02 |
| JP | 2003-311367 | A | 11/2003 | B21C 23/20 |
| JP | 2005-238243 | A | 9/2005 | B21J 5/06 |
| JP | 2013-043200 | A | 3/2013 | B21J 5/08 |

OTHER PUBLICATIONS

"Road vehicles—M12×1,25 spark-plugs with flat seating and 14 mm bi-hexagon and their cylinder head housing," International Standard—ISO 22977. First Edition. Jul. 15, 2005.

* cited by examiner

FIG. 10
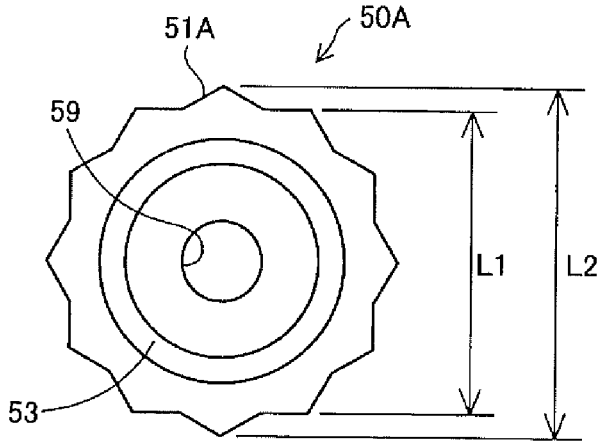
FIG. 11(A)
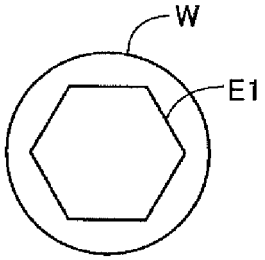
FIG. 11(B)
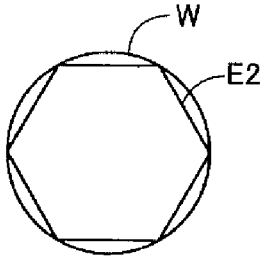
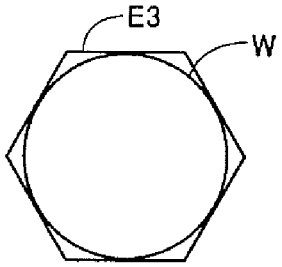
FIG. 11(C)
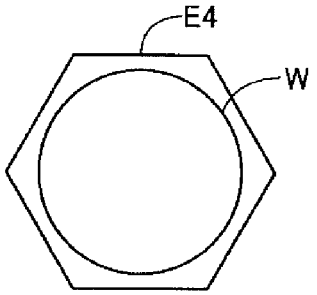
FIG. 11(D)

METHOD FOR MANUFACTURING METAL FITTING, METHOD FOR MANUFACTURING SPARK PLUG, AND METHOD FOR MANUFACTURING SENSOR

RELATED APPLICATIONS

This application is a National Stage of International Application No. PCT/JP2015/003113 filed Jun. 22, 2015, which claims the benefit of Japanese Patent Application No. 2014-132790, filed Jun. 27, 2014.

FIELD OF THE INVENTION

The present invention relates to a metal fitting.

BACKGROUND OF THE INVENTION

A spark plug used for ignition in an internal combustion engine, such as gasoline engine, has a metal fitting for mounting the spark plug to a cylinder head of the engine. The metal fitting of the spark plug generally includes: a thread portion formed with an external thread for screwing into a threaded hole of the engine cylinder head; a tool engagement portion formed engageable with a tool e.g. a spark plug wrench; a seal portion formed between the thread portion and the tool engagement portion at a position continuous to the thread portion so as to ensure the gas-tightness of the inside of the engine; and a thin compression deformation portion formed between the seal portion and the tool engagement portion.

Conventionally, the metal fitting of the spark plug is completed through the processes of cold forging, cutting and thread forming. By the cold forging process, the metal fitting is provided in semi-finished form close to the finished product (see, for example, Japanese Laid-Open Patent Publication No. H07-016693).

As discussed in Japanese Laid-Open Patent Publication No. H07-016693, the cold forging process of the conventional metal fitting manufacturing method contains a plurality of steps. In the step of formation of the tool engagement portion of the finished metal fitting product, it is conceivable to form the tool engagement portion by "drawing" or "bulging".

Herein, "drawing" and "bulging" operations for the formation of the tool engagement portion will be described below with reference to FIG. 11. FIG. 11 is a schematic view showing drawing and bulging operations in the cold forging process. FIGS. 11(A) and (B) shows one example of drawing operation; and FIGS. 11(C) and (D) shows one example of bulging operation. FIG. 11 refers to the case where the tool engagement portion is formed in a substantially regular hexagonal cross-sectional shape. When the tool engagement portion is formed by drawing a base material of substantially cylindrical column shape (including hollow cylindrical column shape), a diagonal dimension of the tool engagement portion becomes smaller than or equal to an outer diameter of the base material as shown in FIGS. 11(A) and (B). When the tool engagement portion is formed by bulging a base material of substantially cylindrical column shape, a diagonal dimension of the tool engagement portion becomes larger than or equal to an outer diameter of the base material as shown in FIGS. 11(C) and (D). When the tool engagement portion is formed in a non-regular polygonal cross-sectional shape by drawing, a maximum diagonal dimension (longest diagonal length) of the tool engagement portion becomes smaller than or equal to an outer diameter of the base material. When the tool engagement portion is formed in a non-regular polygonal cross-sectional shape by bulging, a minimum diagonal dimension (shortest diagonal line length) of the tool engagement portion becomes larger than or equal to an outer diameter of the base material.

To manufacture the metal fitting in which an outer diameter of the seal portion is smaller than the maximum diagonal dimension of the tool engagement portion, the tool engagement portion is conventionally formed by either of the following two processes: 1) forming the tool engagement portion by bulging; and 2) enlarging a part of the base material to an outer diameter larger than the maximum diagonal dimension of the tool engagement portion, thereby providing a portion to be formed into the seal portion (hereinafter referred to as "pre-seal portion") integral with a portion to be formed into the tool engagement portion (hereinafter referred to as "pre-tool engagement portion"), and then, forming the tool engagement portion by drawing (see Japanese Laid-Open Patent Publication No. H07-016693).

The process 1) has the problem that the die for the bulging is high in cost and short in lifetime. The process 2) attains a reduction of die cost as compared to the process 1). In the process 2), however, the pre-seal portion and the pre-tool engagement portion are integrally formed by diameter enlargement such that the outer diameter of the pre-seal portion becomes larger than the outer diameter of the seal portion. The process 2) thus causes an increase of cutting amount during the formation of the seal portion in the cutting process, which leads to the problem of increase in chip treatment workload, deterioration in cutting edge lifetime, increase in material input etc. In other words, these conventional processes face the common problem of high manufacturing cost. This problem is common to various metal fittings with tool engagement portions, such as those for not only spark plugs but also sensors e.g. temperature sensors and other devices. Consequently, there has been a demand to develop a technique for reducing the manufacturing cost of metal fittings.

SUMMARY OF THE INVENTION

The present invention has been made to address the above problem and can be embodied as the following application examples.

(1) According to a first aspect of the present invention, there is provided a manufacturing method of a metal fitting, the metal fitting comprising a tool engagement portion engageable with a tool, the manufacturing method comprising a cold forging process, wherein the cold forging process includes: a step (a) of forming a body portion and a butt portion, the body portion having a first maximum length, the butt portion being continuous to the body portion and having a second maximum length larger than the first maximum length; and a step (b) of drawing at least a part of the butt portion in an axis direction of the metal fitting, thereby forming the tool engagement portion. The first maximum length refers to a maximum length of the body portion in a direction perpendicular to the axis direction. The second maximum direction refers to a maximum length of the butt portion in the direction perpendicular to the axis direction.

In the above metal fitting manufacturing method, the tool engagement portion is formed by drawing during the cold forging process. It is thus possible to, at the time of manufacturing the metal fitting in which the outer diameter of the seal portion is smaller than the diagonal dimension of the tool engagement portion, attain a reduction of die cost and improvement of die lifetime during the cold forging process as compared to the case of forming the tool engagement portion by bulging. It is also possible to achieve a reduction of cutting amount in the subsequent cutting process as compared to the case of enlarging the outer diameter of the entire body portion and then forming the tool engagement portion by drawing. It is accordingly possible to reduce the manufacturing cost of the metal fitting.

(2) In accordance with a second aspect of the present invention, there is provided a manufacturing method of a metal fitting according to the above aspect of the present invention, wherein the manufacturing method further comprises a cutting process of cutting at least a part of the butt portion; and wherein, in the step (b), the tool engagement portion is formed on a region of the butt portion including a first end thereof not adjacent to the body portion.

In this case, the tool engagement portion, the butt portion and the body portion are arranged continuously in order of mention after the execution of the steps (a) and (b). When the body portion is shaped into a seal portion of the finished metal fitting, the butt portion between the body portion and the tool engagement portion is shaped into a compression deformation portion of the finished metal fitting. The compression deformation portion is thin and is conventionally formed by cutting. In the above metal fitting manufacturing method, the butt portion is formed with a maximum length larger than that of the body portion in order to form the tool engagement portion by drawing in the cold forging process. Then, the tool engagement portion is formed by drawing on the region of the butt portion including the first end not adjacent to the body portion. In the cutting process, the diameter of a portion to be formed into the compression deformation portion (i.e. a part of the butt portion) is reduced by cutting. Since the cutting process is conventionally employed as mentioned above, there is no need to add another cutting process. It is thus possible to prevent an increase in the number of operation processes and reduce the manufacturing cost of the metal fitting.

(3) According to a third aspect of the present invention, there is provided a manufacturing method of a metal fitting according to the above aspect of the present invention, wherein the manufacturing method further comprises a cutting process of cutting at least a part of the butt portion; and wherein, in the step (b), the tool engagement portion is formed on a region of the butt portion including a second end thereof adjacent to the body portion such that a maximum cross-sectional diagonal dimension of the tool engagement portion is larger than the first maximum length of the body portion.

In this case, the butt portion, the tool engagement portion, and the body portion are arranged continuously in order of mention after the execution of the steps (a) and (b). As mentioned above, the thin compression deformation portion is provided between the tool engagement portion and the seal portion in the finished metal fitting. In the above metal fitting manufacturing method, the compression deformation portion is formed by cutting a part of the body portion in the cutting process. Since the body portion is smaller in maximum length than the butt portion, it is possible to achieve a reduction of cutting amount in the cutting process and reduce the manufacturing cost of the metal fitting. Further, a crimp portion of the metal fitting is formed by cutting the butt portion in the cutting process. Since the crimp portion is conventionally formed by cutting, there is no need to add another cutting process. It is thus possible to prevent an increase in the number of operation processes.

(4) In accordance with a fourth aspect of the present invention, there is provided a manufacturing method of a metal fitting according to the above aspect of the present invention, wherein the manufacturing method further comprises a cutting process of cutting at least a part of the butt portion; and wherein, in the step (b), the tool engagement portion is formed such that a maximum cross-sectional diagonal dimension of the tool engagement portion is larger than the first maximum length of the body portion.

Even in this case, it is possible to obtain the same effects as above. In the case where the maximum cross-sectional diagonal dimension of the tool engagement portion is larger than the maximum length of the body portion, the tool engagement portion is conventionally formed by bulging or cutting all of the portions including the tool engagement portion. By contrast, the tool engagement portion is formed by drawing in the above metal fitting manufacturing method. It is thus possible to attain a reduction of die cost and cutting cost and obtain a great manufacturing cost reduction effect.

(5) According to a fifth aspect of the present invention, there is provided a manufacturing method of a metal fitting according to the above aspect of the present invention, wherein at least parts of the body and butt portions of the metal fitting manufactured by the manufacturing method have the same maximum lengths as those of the body and butt portions formed in the step (a).

In this case, some part of the metal fitting is finished by the cold forging process without the cutting process. It is thus possible to achieve a reduction of cutting amount and a decrease in the number of operation processes and improve the manufacturing cost of the metal fitting.

It should be noted that the present invention can be embodied in various forms such as a spark plug manufacturing method, a sensor manufacturing method, a metal fitting, a spark plug and a sensor.

BRIEF DESCRIPTION OF THE DRAWINGS

FIG. 10 is a plan view of a tool engagement portion of a metal fitting according to a modified embodiment of the present invention.

FIGS. 11(A)-11(D) are schematic views showing drawing and bulging operations in a cold forging process.

DETAILED DESCRIPTION OF THE PREFERRED EMBODIMENTS

A. First Embodiment

A-1. Configuration of Metal Fitting

Figure 1:
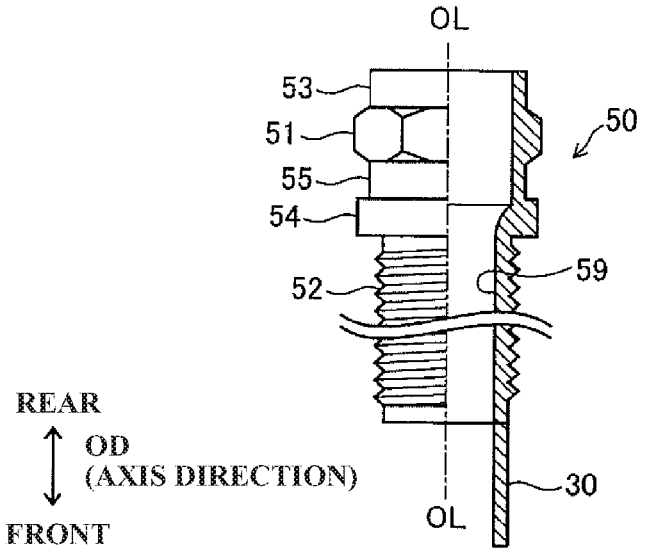
FIG. 1 is a schematic view, partially in section, of a metal fitting produced by a metal fitting manufacturing method according to a first embodiment of the present invention.
Figure 2:
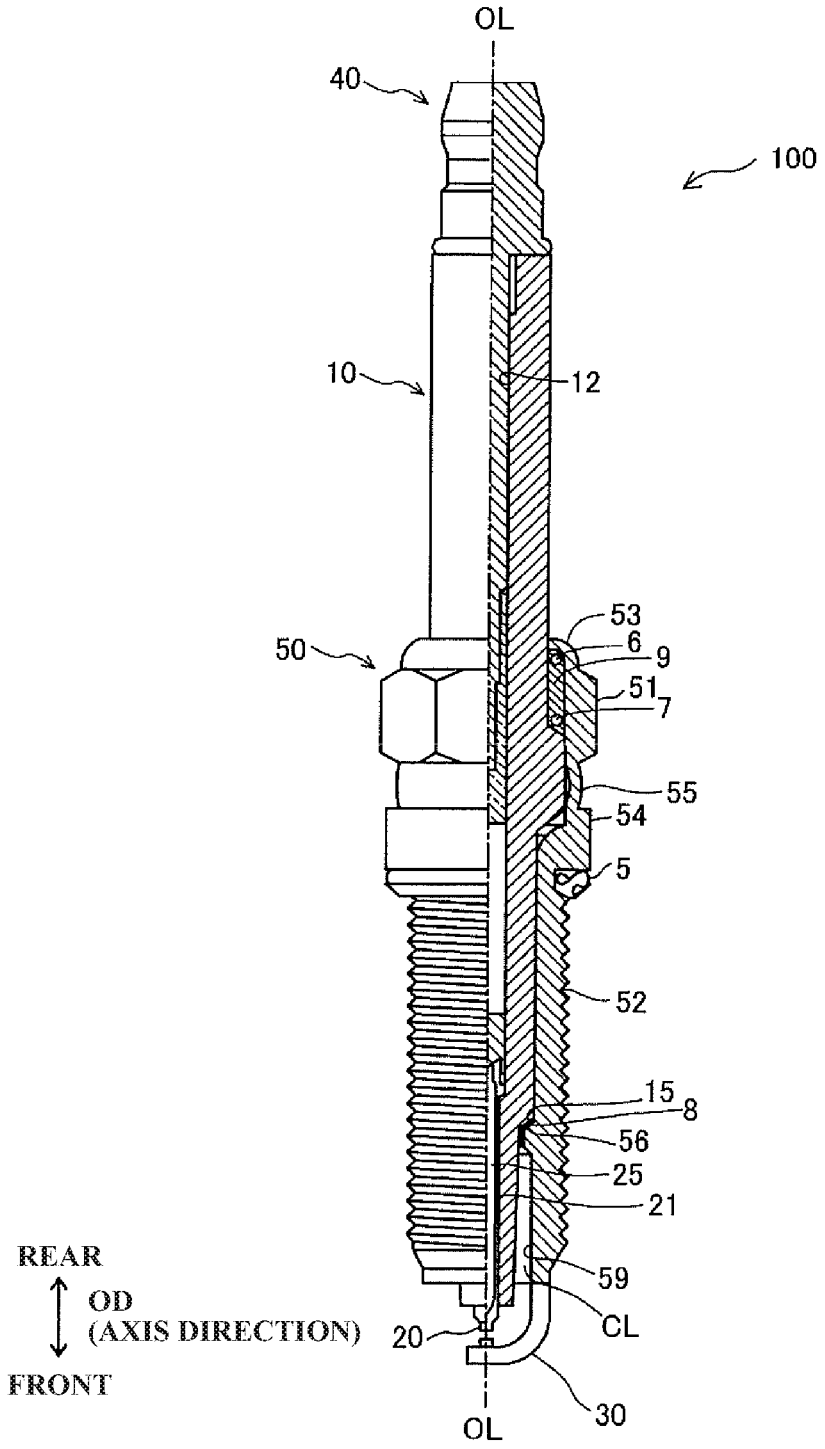
FIG. 2 is a schematic view of a spark plug to which the metal fitting is applied.

FIG. 1 is a schematic view, partially in section, of a metal fitting produced by a metal fitting manufacturing method according to a first embodiment of the present invention. FIG. 2 is a schematic view of a spark plug 100 to which the metal fitting is applied. In FIG. 1, an axis of the fitting 50 is designated by OL. An appearance of the metal fitting 50 is shown on the left side of axis OL in FIG. 1, whereas a cross section of the metal fitting 5—is shown on the right side of the axis OL in FIG. 1. In FIG. 2, an axis of the spark plug 100 is designated by OL. (The axis of the spark plug 100 is in agreement with the axis of the metal fitting 50.) An appearance of the spark plug 100 is shown on the left side of the axis OL in FIG. 2, whereas a cross section of the spark plug 100 is shown on the right side of the axis OL in FIG. 2. In the following description, a direction parallel to the axis OL is referred to as an "axis direction OD". Further, the term "front" refers to a bottom side of the figure (i.e. a side on which the after-mentioned ground electrode 30 is located) in the axis direction; and the term "rear" refers to a top side of the figure (i.e. a side on which the after-mentioned metal terminal 40 is located) in the axis direction.

As shown in FIG. 2, the spark plug 100 includes an insulator 10 as an insulating member, a center electrode 20, a ground electrode (outer electrode) 30 and a metal terminal 40 in addition to the metal fitting 50. The insulator 10 has a cylindrical shape, with an axial hole 12 formed therein, so as to accommodate therein the center electrode 20 and the metal terminal 40. For example, the insulator 10 can be formed by firing a ceramic material such as alumina. The center electrode 20 has a substantially rod-like shape. In the first embodiment, the center electrode 20 includes a cylindrical-shaped cover material 21 and a core material 25 embedded in the cover material 21 and having a higher thermal conductivity than that of the cover material 21. The center electrode 20 is held in the insulator 10. The insulator 10 is held in the metal fitting 50. The ground electrode 30 has a bent, substantially rod-like shape. The ground electrode 30 is joined to a front end portion of the metal fitting 50. The metal terminal 40 is fitted in a rear end side of the insulator 10. There is a spark discharge gap defined between a free end of the ground electrode 30 and a front end of the center electrode 20.

The metal fitting 50 has a substantially cylindrical shape, with a through hole 59 formed therein along the axis direction, so as to accommodate and hold therein a part of the insulator 10 as shown in FIG. 2. An external thread is formed on an outer circumference of the metal fitting 50 such that the spark plug is mounted to a cylinder head of an engine by screwing the external thread into a threaded hole of the engine cylinder head. The metal fitting 50 is formed of a metal material e.g. low carbon steel.

Figure 3:
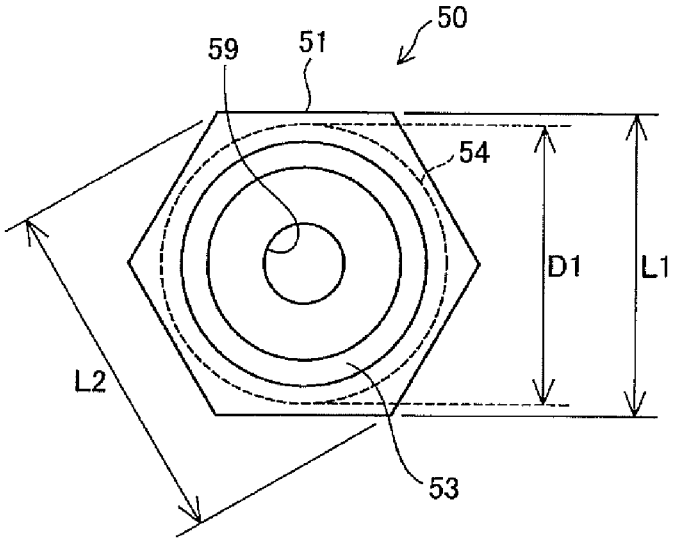
FIG. 3 is a plan view of the metal fitting as viewed from the rear side.

As shown in FIG. 1, the metal fitting 50 generally includes a crimp portion 53, a tool engagement portion 51, a compression deformation portion 55, a seal portion 54 and a thread portion 52 arranged in this order from the rear side. FIG. 3 is a plan view of the metal fitting 50 as viewed from the rear side. The tool engagement portion 51 is substantially regular hexagonal in shape when viewed in plan. At the time of mounting the spark plug to the engine cylinder head, a tool (such as spark plug wrench) is engaged on the tool engagement portion 51. In the first embodiment, the relationship of $D1<L1$ is satisfied where L1 is an opposite side dimension of the tool engagement portion 51; L2 is a diagonal dimension of the tool engagement portion 51; and D1 is an outer diameter of the seal portion 54.

The thread portion 52 has the above-mentioned external thread formed on a circumferential surface thereof and screwed into the threaded hole of the engine cylinder head for mounting of the spark plug to the engine cylinder head.

The seal portion 54 is formed between the thread portion 52 and the tool engagement portion 51 at a position continuous to the read portion 52 so as to, when the spark plug 100 is mounted to the engine cylinder head, prevent the leakage of gas from inside of the engine through the threaded hole of the engine cylinder head. An annular gasket 5, which is formed by bending a plate material, is fitted between the thread portion 52 and the seal portion 54. The seal portion 54 seals the threaded hole of the engine cylinder head through the gasket 5 to prevent air-fuel mixture from leaking from the inside of the engine through the threaded hole.

The crimp portion 53 is formed at a rear end side of the metal fitting 50 as shown in FIG. 1. The crimped portion 53 is made thin. As shown in FIG. 2, the crimp portion 53 is bent radially inwardly by crimping after the insulator 10 is inserted in the through hole 59 of the metal fitting 50. By such crimping, the insulator 10 is held in the metal fitting 50 as one assembly unit.

As shown in FIG. 1, the compression deformation portion 55 is formed between the tool engagement portion 51 and the seal portion 54. The compression deformation portion 55 is made thin as in the case of the crimp portion 53. With the application of compression force during the formation of the crimp portion 53 by crimping, the compression deformation portion 55 is deflected and deformed outwardly to increase the gas-tightness of the inside of the metal fitting 50 as shown in FIG. 2. More specifically, annular ring members 6 and 7 are disposed in a space between an inner circumferential surface of a part of the metal fitting 50 from the tool engagement portion 51 to the crimp portion 53 and an outer circumferential surface of the insulator 10. Further, a talc powder (talc) 9 is filled between the ring members 6 and 7. When the crimp portion 53 is inwardly bent by crimping, the insulator 10 is pressed toward the front within the metal fitting 50 via the ring members 6 and 7 and the talc 9 so that the metal fitting 50 and the insulator 10 are held together as one unit with a reduced diameter portion 15 of the insulator 10 retained on a step portion 56 of the inner circumferential surface of the metal fitting 50. An annular plate packing 8 is disposed between the reduced diameter portion 15 of the insulator 10 and the step portion 56 of the metal fitting 50 so as to maintain gas-tightness between the metal fitting 50 and the insulator 10 and prevent the leakage of combustion gas. For example, the plate packing 8 can be formed of a high thermal conductive material such as copper or aluminum. When the plate packing 8 is high in thermal conductivity, heat of the insulator 10 is efficiently conducted to the step portion 56 of the metal fitting 50 via the plate packing. It is thus possible to increase the heat radiation performance of the spark plug 100 for improvement of heat resistance. The compression deformation portion 55 is outwardly deflected and deformed with the application of compression force during the crimping, thereby enhancing the compression stroke of the talc 9 and increasing the gas-tightness of the inside of the metal fitting 50. There is a clearance CL of predetermined dimension left between the insulator 10 and a part of the metal fitting 50 located front of the step portion 56.

A-2. Manufacturing Method of Metal Fitting

Figure 4:
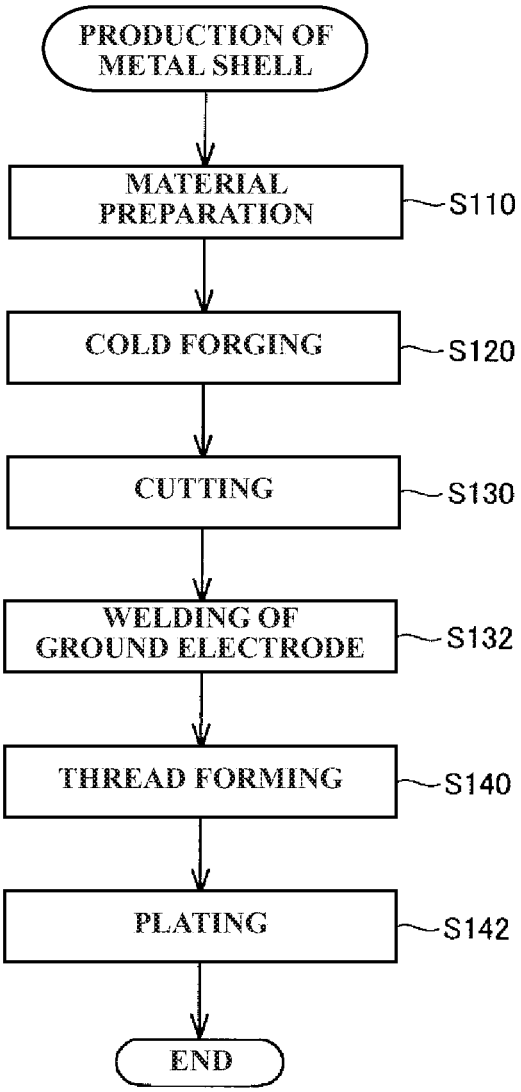
FIG. 4 is a flow chart of the metal fitting manufacturing method according to the first embodiment of the present invention.

A manufacturing method of the metal fitting 50 according to the first embodiment will be described below with reference to FIG. 4 and FIGS. 5(A)-5(F). FIG. 4 is a flow chart of the manufacturing method of the metal fitting 50 according to the first embodiment. FIGS. 5(A)-5(F) are schematic views showing, in half section, semi-finished products obtained in respective steps of cold forging process of the manufacturing method of the metal fitting 50 according to the first embodiment. In FIGS. 5(A)-5(F), appearance and cross section of each semi-finished forging product are shown on the left and right side of the axis, respectively. The axis of each semi-finished forging product is in agreement with the axis of the metal fitting 50.

As shown in FIG. 4, the manufacturing method of the metal fitting 50 according to the first embodiment includes the processes of: preparing a starting material (step S110); forming a semi-finished product 500F (FIG. 5(F)) of the metal fitting 50 by cold-forging the starting material (step S120); cutting the semi-finished product 500F (step S130); welding the ground electrode 30 to the semi-finished product after the cutting (hereinafter also referred to as "semi-finished cutting product"); forming the external thread (step S140); and performing plating treatment (step S142). The metal fitting 50 (FIG. 1) is completed through these processes.

In step S110, a substantially cylindrical column-shaped metal material is used as the starting material (not shown). The starting material is prepared by e.g. shear-cutting a metal wire.

In the first embodiment, the cold forging process (step S120) contains six cold forging operations (steps). The cold forging process will be explained in detail below with reference to FIGS. 5(A)-5(F). In the following explanation, bottom and top sides of the figure are respectively referred to as front and rear sides of the semi-finished product in correspondence with those of the metal fitting 50.

Figure 5C:
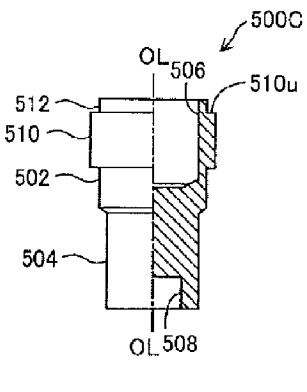
FIGS. 5(A)-5(F) are schematic views showing, in half section, semi-finished products obtained in respective steps of cold forging process of the metal fitting manufacturing method according to the first embodiment of the present invention.
Figure 5B:
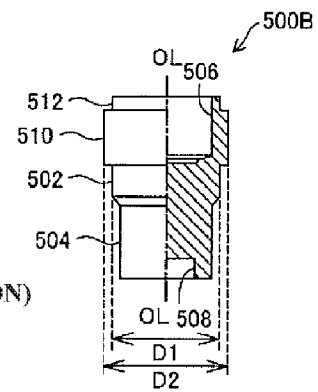
Figure 5A:
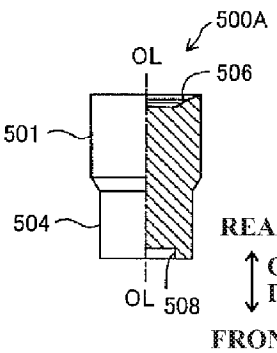

First, the starting material is subjected to extrusion (the first cold forging step) so as to narrow a front end region of the starting material and thereby form a semi-finished product 500A (FIG. 5(A)). The semi-finished product 500A is provided with a pre-body portion 501 and a leg portion 504. The pre-body portion 501 has a substantially cylindrical column shape with an outer diameter substantially equal to that of the starting material. The leg portion 504, which is to be formed into the thread portion 52 in the later process step, has a substantially cylindrical column shape with an outer diameter smaller than that of the pre-body portion 501. First and second holes 506 and 508 are made in rear and front ends of the semi-finished product 500A, respectively.

It is herein noted that, in the present specification, the expression "substantially cylindrical column shape" includes the concept of "hollow cylindrical column shape" and includes the concepts of "shape having a cross section slightly deviated from a perfect circle" and "shape having an elliptical cross section" without being limited to a perfect circular cross section.

Next, the semi-finished product 500A is processed into a semi-finished product 500B (FIG. 5(B)) in the second cold forging step. In the second cold forging step, the first and second holes 506 and 508 are elongated; and a middle region of the pre-body portion 501 of the semi-finished product 500A in the axis direction OD is bulged to form a pre-crimp portion 512, a butt portion 510 and a body portion 502. Namely, the semi-finished product 500B is provided with the pre-crimp portion 512, the butt portion 510, the body portion 502 and the leg portion 504.

The pre-crimp portion 512, which is to be formed into the crimp portion 53 in the later process step, has a substantially cylindrical column shape with an outer diameter substantially equal to the outer diameter D1 of the body portion 502. The butt portion 510, which is to be formed into the tool engagement portion 510 and the compression deformation portion 55 in the later process steps, has a substantially cylindrical column shape with an outer diameter D2 larger than the outer diameter D1 of the body portion 502 and larger than the diagonal dimension L2 of the tool engagement portion 51 of the metal fitting 50. The body portion 502, which is to be formed into the seal portion 54 in the later process step, has a substantially cylindrical column shape with an outer diameter substantially equal to the outer diameter D1 of the seal portion 54. In the first embodiment, the outer diameter of the body portion corresponds to the claimed first maximum length; and the outer diameter of the butt portion corresponds to the claimed second maximum length.

The semi-finished product 500B is processed into a semi-finished product 500C (FIG. 5(C)) in the third cold forging step. In the third cold forging step, the first and second holes 506 and 508 are further elongated; and the body portion 502 and the leg portion 504 are elongated.

Figure 5F:
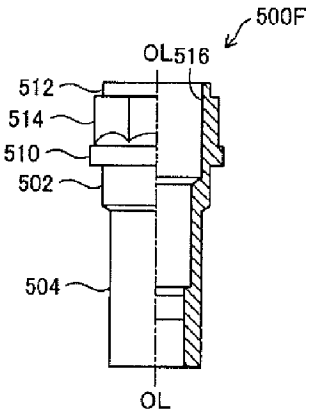
Figure 5E:
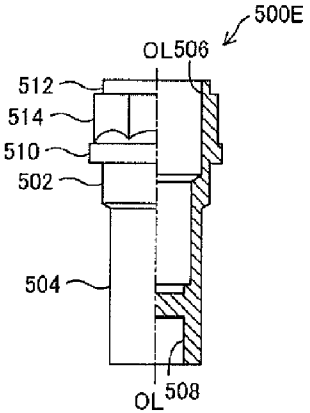
Figure 5D:
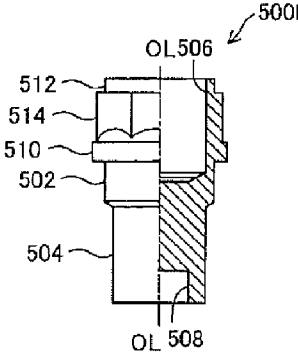

The semi-finished product 500C is further processed into a semi-finished product 500D (FIG. 5(D)) in the fourth cold forging step. In the fourth cold forging step, the first hole 506 is further elongated; and a rear end region of the butt portion 510 of the semi-finished product 500C (i.e. a region of the butt portion 510 including a first end 510*u* not adjacent to the body portion 502) is subjected to drawing to form a tool engagement portion 514. Namely, the semi-finished product 500D is provided with the pre-crimp portion 512, the tool engagement portion 514 the butt portion 510, the body portion 502 and the leg portion 504. The tool engagement portion 514 corresponds to the tool engagement portion 51 of the finished metal fitting 50 and has a substantially regular hexagonal outer shape in plan view.

The semi-finished product 500D is processed into a semi-finished product 500E (FIG. 5(E)) in the fifth cold forging step. In the fifth cold forging step, the first and second holes 506 and 508 are further elongated; and the leg portion 504 is further elongated.

The semi-finished product 500E is then processed into a semi-finished product 500F (FIG. 5(F)) by the sixth cold forging operation. In the sixth cold forging operation, the first and second holes 506 and 508 are connected to and communicated with each other to define a through hole 516. The semi-finished product 500F, which is the final product of the cold forging process (step S120 in FIG. 4), has a substantially cylindrical shape (substantially hollow cylindrical column shape) where the through hole 516 is identical to the through hole 59 of the finished metal fitting 50.

In step S130, cutting is performed on outer circumferential surfaces of the pre-crimp portion 512, the tool engagement portion 514, the butt portion 510 and the body portion 512 of the semi-finished product 500F obtained in the cold forging process (S120), so as to correspond to the crimp portion 53, the tool engagement portion 51, the compression deformation portion 55 and the seal portion 54 of the metal fitting 50. Thus provided is a semi-finished cutting product.

In step S132, the ground electrode 30 is welded to the leg portion 504 of the semi-finished cutting product. In step S140, thread forming (rolling) is performed on an outer circumferential surface of the leg portion 504 so as to form the thread portion 52 of the metal fitting 50. In step 142, nickel plating is applied to the surface of the metal fitting for corrosion protection. In this way, the metal fitting 50 is completed.

The spark plug 100 (FIG. 2) is manufactured by assembling the above-obtained metal fitting 50 with the other plug components.

A-3. Effects of First Embodiment

The effects of the metal fitting manufacturing method according to the first embodiment will be explained below in comparison with comparative metal fitting manufacturing methods 1 and 2.

The comparative metal fitting manufacturing methods 1 and 2 are similar to the metal fitting manufacturing method according to the first embodiment, except for the cold forging process (step S120 in FIG. 4). Hence, an explanation will be given only of the cold forging processes of the comparative metal fitting manufacturing methods; and explanations of the other processes of the comparative metal fitting manufacturing methods will be omitted herefrom. It is herein assumed that, in each of the comparative metal fitting manufacturing methods 1 and 2, a metal fitting of the same shape as the metal fitting 50 of FIG. 1 is manufactured.

The effects of the metal fitting manufacturing method according to the first embodiment against the comparative metal fitting manufacturing method 1 will be now explained below. FIG. 6 is a schematic view showing, in half section, semi-finished products obtained in respective step of cold forging process of the comparative metal fitting manufacturing method 1. In FIG. 6, appearance and cross section of each semi-finished forging product are shown on the left and right side of the axis, respectively, as in the case of FIG. 5.

In the comparative metal fitting manufacturing method 1, the cold forging process contains five cold forging operations (steps).

Figure 6A:
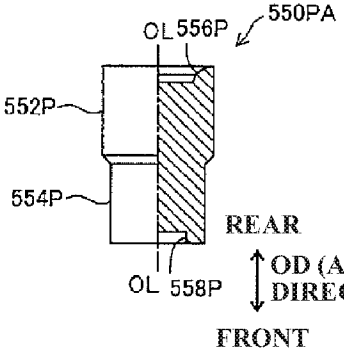
FIGS. 6(A)-6(E) are schematic views showing, in half section, semi-finished products obtained in respective steps of cold forging process of a comparative example method 1.

A starting material is first subjected to extrusion (the first cold forging step) so as to narrow a front end region of the starting material and thereby form a semi-finished product 550PA (FIG. 6(A)). The semi-finished product 550PA is provided with a body portion 552P and a leg portion 554P. The body portion 552P has a substantially cylindrical column shape with an outer diameter substantially equal to that of the starting material and smaller than the diagonal dimension of the tool engagement portion 51. The leg portion 554P, which is to be formed into the thread portion 52 in the later process step, has a substantially cylindrical column shape with an outer diameter smaller than that of the body portion 552P. First and second holes 556P and 558P are made in rear and front ends of the semi-finished product 550PA, respectively.

Figure 6B:
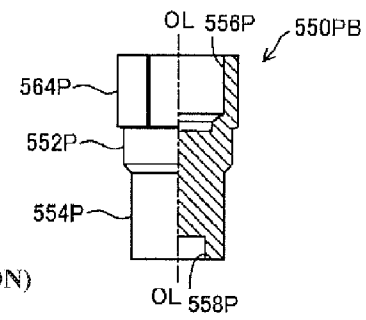

The semi-finished product 550PA is processed into a semi-finished product 550PB (FIG. 6(B)) in the second cold forging step. In the second cold forging step, the first and second holes 556P and 558P are elongated; and a rear end region of the body part 552P of the semi-finished product 550PA in the axis direction OD is bulged to form a tool engagement portion 564P. Namely, the semi-finished product 550PB is provided with the tool engagement portion 564P, the body portion 552P and the leg portion 554P. The tool engagement portion 564P corresponds to the tool engagement portion 51 of the finished metal fitting 50 and has a substantially regular hexagonal outer shape in plan view. In the comparative metal fitting manufacturing method 1, the crimp portion 53 is formed by cutting a rear end region of the tool engagement portion 564P in the later process step. The compression deformation portion 55 and the seal portion 54 are formed by cutting the body portion 552P in the later process step.

Figure 6C:
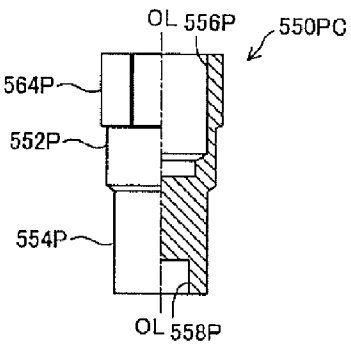

The semi-finished product 550PB is processed into a semi-finished product 550PC (FIG. 6(C)) in the third cold forging step. In the third cold forging step, the first and second holes 556P and 558P are further elongated; and the body portion 552P and the leg portion 554P are elongated.

Figure 6D:
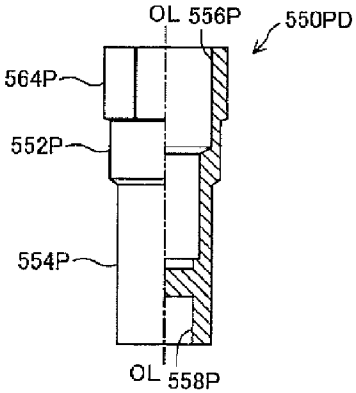

The semi-finished product 550PC is processed into a semi-finished product 550PD (FIG. 6(D)) in the fourth cold forging step. In the fourth cold forging step, the first and second holes 556P and 558P are further elongated; and the leg portion 554P is further elongated.

Figure 6E:
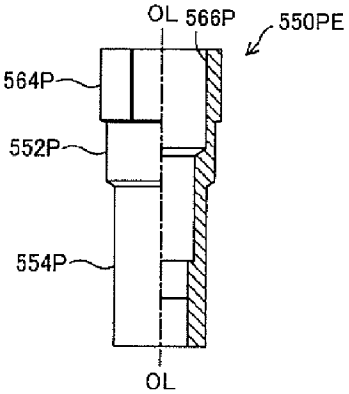

The semi-finished product 550PD is then processed into a semi-finished product 550PE (FIG. 6(E)) in the fifth cold forging step. In the fifth cold forging step, the first and second holes 556P and 558P are connected to and communicated with each other to define a through hole 566P. The semi-finished product 550PE is the final product of the cold forging process in the comparative metal fitting manufacturing method 1.

In the comparative metal fitting manufacturing method 1, the tool engagement portion 564P is formed by bulging during the second step of the cold forging process. The die for the bulging is expensive. Due to the fact that the hollow part of the bulging die used in the comparative metal fitting manufacturing method 1 has a regular hexagonal shape in plan view according to the regular hexagonal plan shape of the tool engagement portion 51 of the metal fitting 50, the bulging die is likely to be broken due to the concentration of stress on corners of the hexagonal hollow die part and is short in lifetime.

In the metal fitting manufacturing method according to the first embodiment, on the other hand, the body portion 502 is formed in a substantially circular column shape with an outer diameter D1 substantially equal to the outer diameter of the seal portion 54 of the metal shell 50 (i.e. smaller than the diagonal dimension L2 of the tool engagement portion 51 of the metal fitting 50) during the second step of the cold forging process. Further, the butt portion 510 is formed, at a position continuous to the body portion 502, with an outer diameter D2 larger than the outer diameter D1 of the body portion 510 during second step of the cold forging process. The outer diameter D2 of the butt portion 510 is larger than the diagonal dimension L2 of the tool engagement portion 51 of the metal fitting 50. Thus, the tool engagement portion 51 of the metal fitting 50 is formed by drawing a part of the butt portion in the metal fitting manufacturing method according to the first embodiment. The die for the drawing is lower in cost and longer in lifetime than the die for the bulging. It is therefore possible to attain a reduction of die cost and reduce the manufacturing cost of the metal fitting.

Next, the effects of the metal fitting manufacturing method according to the first embodiment against the comparative metal fitting manufacturing method 2 will be explained below. FIG. 7 is a schematic view showing, in half section, semi-finished products obtained in respective steps of cold forging process of the comparative metal fitting manufacturing method 2.

In the comparative metal fitting manufacturing method 2, the cold forging process contains six cold forging operations (steps) as in the metal fitting manufacturing method according to the first embodiment.

Figure 7C:
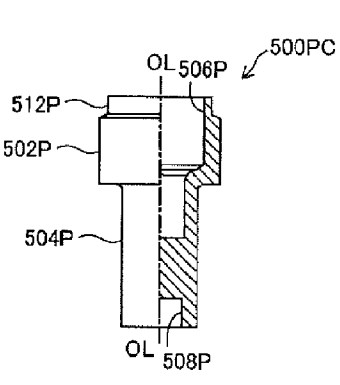
FIGS. 7(A)-7(F) are schematic views showing, in half section, semi-finished products obtained in respective steps of cold forging process of a comparative example method 2.
Figure 7B:
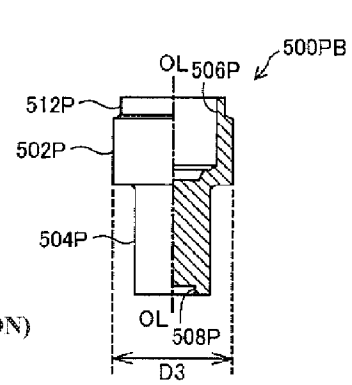
Figure 7A:
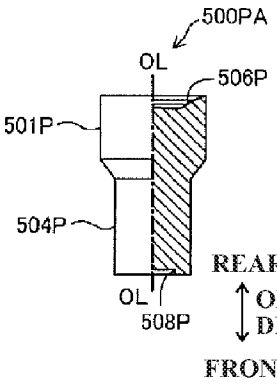

A starting material is first subjected to extrusion (the first cold forging step) so as to narrow a front end region of the starting material and thereby form a semi-finished product 500PA (FIG. 7(A)). The semi-finished product 500PA is provided with a pre-body portion 501P and a leg portion 504P. The pre-body portion 501P has a substantially cylindrical column shape with an outer diameter substantially equal to that of the starting material. The leg portion 504P, which is to be formed into the thread portion 52 in the later process step, has a substantially cylindrical column shape with an outer diameter smaller than that of the pre-body portion 501P. First and second holes 506P and 508P are made in rear and front ends of the semi-finished product 500PA, respectively.

The semi-finished product 500PA is processed into a semi-finished product 500PB (FIG. 7(B)) in the second cold forging step. In the second cold forging step, the first and second holes 506P and 508P are elongated; and a front end region of the pre-body portion 501P of the semi-finished product 500PA in the axis direction OD is bulged to form a pre-crimp portion 512P and a body portion 502P. Namely, the semi-finished product 500PB is provided with the pre-crimp portion 512P, the body portion 502P and the leg portion 504P.

The pre-crimp portion 512P, which is to be formed into the crimp portion 53 in the later process step, has a substantially cylindrical column shape with an outer diameter substantially equal to that of the pre-body portion 501P of the semi-finished product 500PA. The body portion 502, which is to be formed into the tool engagement portion 51, the compression deformation portion 55 and the seal portion 54 in the later process steps, has a substantially cylindrical column shape with an outer diameter D3 larger than the diagonal dimension L2 of the tool engagement portion 51 of the metal fitting 50. In this comparative example, the outer diameter D3 of the body portion 502 is substantially equal to the outer diameter D2 of the butt portion 510 of the first embodiment and larger than the outer diameter D1 of the seal portion 54 of the metal fitting 50.

The semi-finished product 500PB is processed into a semi-finished product 500PC (FIG. 7(C)) in the third cold forging step. In the third cold forging step, the first and second holes 506P and 508P are further elongated; and the leg portion 554P is elongated.

Figure 7F:
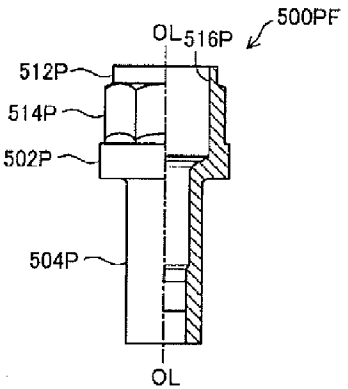
Figure 7E:
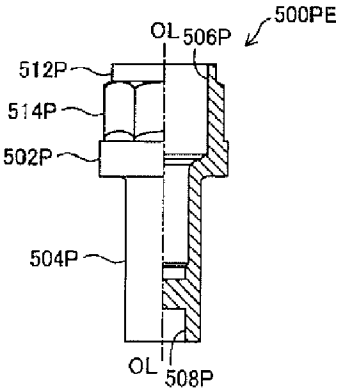
Figure 7D:
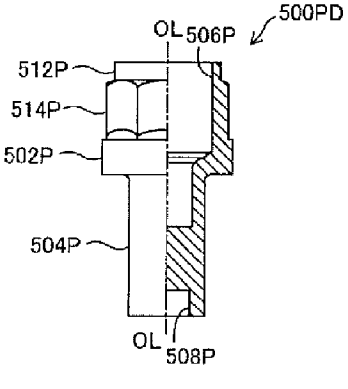

The semi-finished product 500PC is processed into a semi-finished product 500PD (FIG. 7(D)) in the fourth cold forging step. In the fourth cold forging step, the first hole 506P is further elongated; a rear end region of the body portion 502P of the semi-finished product 500PC is subjected to drawing to form a tool engagement portion 514P; and the leg portion 504P is further elongated. Namely, the semi-finished product 500PD is provided with the pre-crimp portion 512P, the tool engagement portion 514P, the body portion 502P and the leg portion 504P. The tool engagement portion 514P corresponds to the tool engagement portion 51 of the finished metal fitting 50 and has a substantially regular hexagonal outer shape in plan view.

The semi-finished product 500PD is processed into a semi-finished product 500PE (FIG. 7(E)) in the fifth cold forging step. In the fifth cold forging step, the first and second holes 506P and 508P are further elongated; and the leg portion 504 is further elongated.

The semi-finished product 500PE is processed into a semi-finished product 500PF (FIG. 7(F)) in the sixth cold forging step. In the sixth cold forging step, the first and second holes 506P and 508P are connected to and communicated with each other to define a through hole 516P. The semi-finished product 500PF is the final product of the cold forging step in the comparative metal fitting manufacturing method 2.

In the comparative metal fitting manufacturing method 2, the body portion 502P is formed in a substantially cylindrical column shape with an outer diameter D3 larger than the diagonal dimension L2 of the tool engagement portion 51 of the metal fitting 50 during the second step of the cold forging process. The tool engagement portion 51 of the metal fitting 50 is thus formed by drawing a part of the body portion in the comparative metal fitting manufacturing method 2 in the same manner as in the metal fitting manufacturing method according to the first embodiment.

In the comparative metal fitting manufacturing method 2, however, the body portion 502P, which is to be formed into the seal portion 54 in the later process step, is substantially cylindrical column-shaped with an outer diameter D3 larger than the outer diameter D1 of the seal portion 54 in order to form the tool engagement portion by drawing in the cold forging process. Then, the outer circumference of the body portion 502P is subjected to cutting in the cutting process as will be explained later, thereby forming the seal portion 54.

In the metal fitting manufacturing method according to the first embodiment, on the other hand, the body portion 502, which is to be formed into the seal portion 54 in the later process step, is substantially cylindrical column-shaped with an outer diameter D1 substantially equal to that of the seal portion 54 in the cold forging process. Further, the butt portion 510 is formed, at a position continuous to the body portion 502, in a substantially cylindrical shape with an outer diameter D2 larger than the outer diameter D1 of the body portion 502 and larger than the diagonal dimension L2 of the tool engagement portion 51. The tool engagement portion 514 is then formed by drawing at least a part of the butt portion 510 in the cold forging process. Without performing the cutting process on the outer circumference of the body portion 502, the seal portion 54 is substantially finished by forging; and the tool engagement portion 515 is formed by drawing.

Figure 8A:
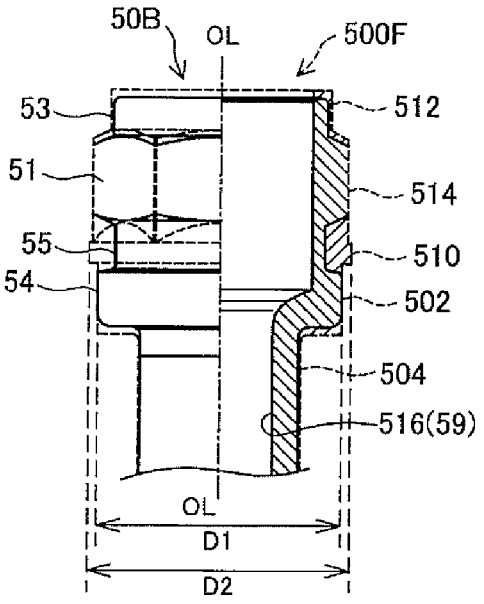
FIGS. 8(A) and 8(B) are schematic views showing a difference in cutting amount between a cutting process of the metal fitting manufacturing method according to the first embodiment and a cutting process of the comparative example method 2.
Figure 8B:
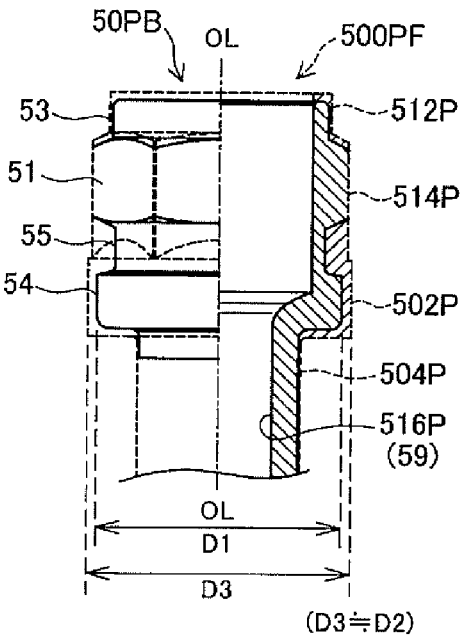

The cutting processes of the first embodiment and the above comparative example will be explained below with reference to FIG. 8. FIG. 8 is a schematic view showing a difference in cutting amount between the cutting process of the metal fitting manufacturing method according to the first embodiment and the cutting process of the comparative metal fitting manufacturing method 2. FIG. 8(A) shows the semi-finished product before and after the cutting process in the metal fitting manufacturing method according to the first embodiment; and FIG. 8(B) shows the semi-finished product before and after the cutting process in the comparative metal fitting manufacturing method 2. In FIG. 8, the final semi-finished product of the cold forging process is indicated by a broken line; and the semi-finished product after the cutting process is indicated by a solid line. In order to clearly indicate the cutting amount during the cutting process, a part of the semi-finished product cut by the cutting process is indicated by cross-sectional hatching different from that of the semi-finished product after the cutting process.

As shown in FIG. 8(A), cutting is mainly performed on a front end region of the tool engagement portion 514 and the butt portion 510 of the semi-finished product 500F during the cutting process, thereby forming the tool engagement portion 51 and the compression deformation portion 55, in the metal fitting manufacturing method according to the first embodiment. During the cutting process, cutting is also performed on the pre-crimp portion 512 and the body portion 502 for deburring, chamfering, fine adjustment e.g. surface state adjustment and the like. The semi-finished cutting product 50B is provided by cutting the semi-finished product 500F. The tool engagement portion 51 is formed by cutting the tool engagement portion 514 to a shorter axial length during the cutting process. In the metal fitting manufacturing method according to the first embodiment, the outer circumferential shape (regular hexagonal shape) of the tool engagement portion remains the same even after the cutting process as shown in the figure. Since the body portion 502 is made substantially equal in outer diameter to the seal portion 54 in the first embodiment, the outer circumferential shape (outer diameter) of the body portion 502 remains the same even after the chamfering etc.

In the comparative metal fitting manufacturing method 2, cutting is mainly performed on a front end region of the tool engagement portion 514, a rear end region of the body portion 502P and an outer circumferential surface of the body portion 502P of the semi-finished product 500PF during the cutting process, thereby forming the tool engagement portion 51, the compression deformation portion 55 and the seal portion 54, as shown in FIG. 8(B). During the cutting process, cutting is also performed on the pre-crimp portion 512P and the body portion 502P for deburring, chamfering, fine adjustment e.g. surface state adjustment and the like. The tool engagement portion 51 is formed by cutting the tool engagement portion 514P to a shorter axial length during the cutting process. In the comparative metal fitting manufacturing method 2, the outer circumferential shape (regular hexagonal shape) of the tool engagement portion remains the same even after the cutting process as shown in the figure. However, the outer diameter D3 of the body portion 502P is larger than the outer diameter D1 of the seal portion 54 and thus is reduced to D1 by cutting during the cutting process in the comparative metal fitting manufacturing method 2. It is consequently possible to achieve a reduction of cutting amount during the cutting process subsequent to the cold forging step, suppress an increase in chip treatment workload, deterioration in cutting edge lifetime, increase in material input etc. and thereby reduce the manufacturing cost of the metal fitting in the metal fitting manufacturing method according to the first embodiment as compared to the comparative metal fitting manufacturing method 2.

As shown in FIG. 8, the compression deformation portion 55 of the metal fitting 50 is thin and is formed by cutting even in the comparative metal fitting manufacturing method 2. Without being limited to the comparative metal fitting manufacturing method 2, it has been conventional to form the compression deformation portion 55 by cutting. In the first embodiment, the body portion 502, which is to be formed into the seal portion 54, is made substantially equal in outer diameter to the seal portion 54 so that there is no need to perform cutting on the outer circumference of the body portion 502. Further, the butt portion 510, a part of which is to be formed into the compression deformation portion 55 in the later cutting process, is formed by diameter enlargement so that the tool engagement portion 514 is formed by drawing a part of the butt portion 510 in the first embodiment. It is thus possible to reduce the manufacturing cost of the metal fitting, without increase of cutting operation, by forming the butt portion 510 so as to correspond to the compression deformation portion 55 in the metal fitting manufacturing method according to the first embodiment.

B. Second Embodiment

B-1. Manufacturing Method of Metal Fitting

A manufacturing method of a metal fitting according to a second embodiment of the present invention will be described below with reference to FIGS. 9(A)-9(F). The metal fitting manufactured by the metal fitting manufacturing method according to the second embodiment is the same in shape as the metal fitting 50 (FIG. 1) manufactured by the metal fitting manufacturing method according to the first embodiment. In the second embodiment, like parts and portion of the metal fitting are designated by like reference numerals; and explanations of the configuration of the metal fitting will be omitted herefrom. The metal fitting manufacturing method according to the second embodiment is similar to the metal fitting manufacturing method according to the first embodiment, except for the cold forging process. Hence, an explanation will be given only of the cold forging process of the second embodiment; and explanations of the other processes of the second embodiment will be omitted herefrom.

FIGS. 9(A)-9(F) are schematic views showing, in half section, semi-finished products obtained in respective steps of cold forging processes of the metal fitting manufacturing method according to the second embodiment. In FIGS. 9(A)-9(F), appearance and cross section of each semi-finished forging product are shown on the left and right side of the axis, respectively, as in the case of FIG. 5.

In the metal fitting manufacturing method according to the second embodiment, the cold forging step contains six cold forging operations (steps) as in the metal fitting manufacturing method according to the first embodiment.

Figures 9A, 9B, 9C, 9D, 9E, 9F:
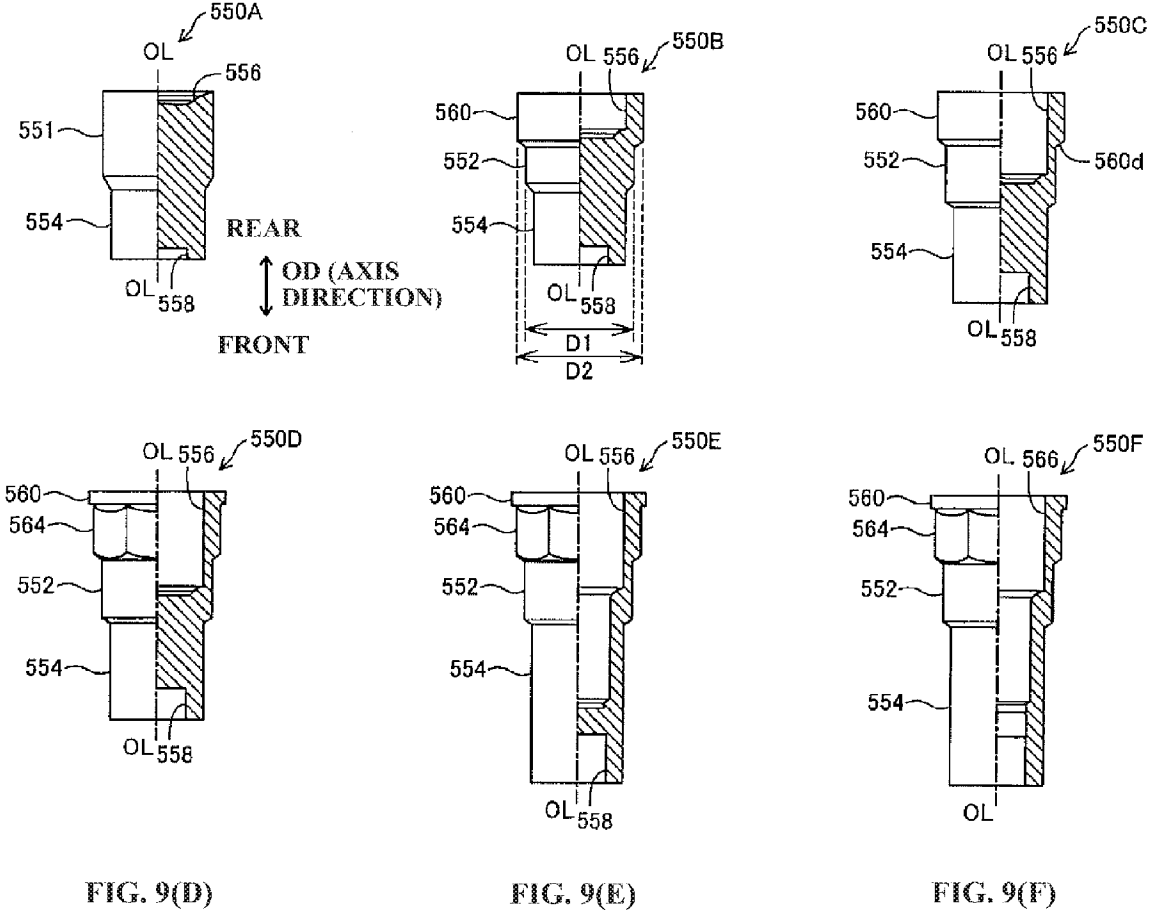
FIGS. 9(A)-9(F) are schematic views showing, in half section, semi-finished products obtained in respective steps of cold forging process of a metal fitting manufacturing method according to a second embodiment of the present invention.

First, a starting material is subjected to extrusion (the first cold forging step) so as to narrow a front end region of the starting material and thereby form a semi-finished product 550A (FIG. 9(A)). The semi-finished product 550A is provided with a pre-body portion 551 and a leg portion 554. The pre-body portion 551 has a substantially cylindrical column shape with an outer diameter substantially equal to that of the starting material. The leg portion 554, which is to be formed into the thread portion 52 in the later process step, has a substantially cylindrical column shape with an outer diameter smaller than that of the pre-body portion 551. First and second holes 556 and 558 are made in rear and front ends of the semi-finished product 550A, respectively.

Next, the semi-finished product 550A is processed into a semi-finished product 550B (FIG. 9(B)) in the second cold forging step. In the second cold forging step, the first and second holes 506 and 508 are elongated; and a rear end region of the pre-body portion 551 of the semi-finished product 550A in the axis direction OD is bulged to form a butt portion 560 and a body portion 552. Namely, the semi-finished product 550B is provided with the butt portion 560, the body portion 552 and the leg portion 554. The butt portion 560, which is to be formed into the crimp portion 53 and the tool engagement portion 51 in the later process steps, has a substantially cylindrical column shape with an outer diameter D2 larger than the diagonal dimension L2 of the tool engagement portion 51 of the metal fitting 50 and larger than the outer diameter D1 of the body portion 552. The body portion 552, which is to be formed into the compression deformation portion 55 and the seal portion 54 in the later process steps, has a substantially cylindrical column shape with an outer diameter D1 equal to the outer diameter D1 of the seal portion 54 of the metal fitting 50.

The semi-finished product 550B is processed into a semi-finished product 550C (FIG. 9(C)) in the third cold forging step. In the third cold forging step, the first and second holes 556 and 558 are further elongated; and the body portion 552 and the leg portion 554 are elongated.

The semi-finished product 550C is processed into a semi-finished product 550D (FIG. 9(D)) in the fourth cold forging step. In the fourth cold forging step, the first holes 556 is further elongated; and a front end region of the butt portion 560 of the semi-finished product 550C (i.e. a region of the butt portion 560 including a second end 560*d* adjacent to the body portion 552) is subjected to drawing to form a tool engagement portion 564. Namely, the semi-finished product 550D is provided with the butt portion 560, the tool engagement portion 564, the body portion 552 and the leg portion 554. In the second embodiment, the butt portion 560 is subjected to cutting in the subsequent cutting process to thereby form the crimp portion 53. The tool engagement portion 564 corresponds to the cool engagement portion 51 of the metal fitting 50 and has a substantially regular hexagonal outer shape in plan view.

The semi-finished product 550D is processed into a semi-finished product 550E (FIG. 9(E)) in the fifth cold forging step. In the fifth cold forging step, the first and second holes 556 and 558 are further elongated; and the leg portion 554 is further elongated.

The semi-finished product 550E is processed into a semi-finished product 550F (FIG. 9(F)) in the sixth cold forging step. In the sixth cold forging step, the first and second holes 556 and 558 are connected to and communicated with each other to define a through hole 566. The semi-finished product 550F, which is the final product of the cold forging process in the second embodiment, has a substantially cylindrical shape (substantially hollow cylindrical column shape) where the above-defined through hole is identical to the through hole 59 of the metal fitting 50.

B-2. Effects of Second Embodiment

In the metal fitting manufacturing method according to the second embodiment, the body portion 552 is formed in a substantially cylindrical shape with an outer diameter D1 smaller than the diagonal dimension L2 of the tool engagement portion 51 of the metal fitting 50. Further, the butt portion 560 is formed, at a position continuous to the body portion 552, in a substantially cylindrical column shape with an outer diameter D2 larger than the diagonal dimension L2 of the tool engagement portion 51 of the metal fitting 50. The tool engagement portion 564 is then formed by drawing a part of the butt portion. Consequently, it is possible in the metal fitting manufacturing method according to the second embodiment to attain a reduction of die cost, suppress a deterioration in die lifetime and thereby reduce the manufacturing cost of the metal fitting as compared to the comparative metal fitting manufacturing method 1. Moreover, the body portion 552, which is to be formed into the seal portion 54 in the later process step, is substantially cylindrical column-shaped with an outer diameter D1 substantially equal to that of the seal portion 54 in the metal fitting manufacturing method according to the second embodiment. The seal portion 54 is thus substantially finished by forging without performing the cutting process on the outer circumference of the body portion 552. It is consequently possible in the metal fitting manufacturing method according to the second embodiment to achieve a reduction of cutting amount during the cutting process subsequent to the cold forging process, suppress an increase in chip treatment workload, deterioration in cutting edge lifetime, increase in material input etc. and thereby reduce the manufacturing cost of the metal fitting as compared to the comparative metal fitting manufacturing method 2. The metal fitting manufacturing method according to the first embodiment is preferable in that the crimp portion 53 is also substantially finished by forging.

C. Modifications

The present invention is not limited to the above specific embodiments and can be embodied in various forms without departing from the scope of the present invention. For example, it is possible to appropriately replace or combine any of the technical features mentioned above in "Summary of the Invention" and "Description of the Embodiments" in order to solve a part or all of the above-mentioned problems or achieve a part or all of the above-mentioned effects. Any of these technical features, if not explained as essential in the present specification, may be eliminated as appropriate. For example, the following modifications are possible.

C-1. First Modified Example

In the above embodiment, the metal fitting 50 satisfies the relationship of $D1<L1$ where L1 is the opposite side dimension of the tool engagement portion 51; L2 is the diagonal dimension of the tool engagement portion 51; and D1 is the outer diameter of the seal portion 54. The metal fitting is not however limited to this dimensional relationship. The metal fitting may alternatively satisfy the relationship of $L1 \leq D1<L2$ or $D1<L2$. Even in such a case, it is possible to reduce the manufacturing cost of the metal fitting by the adoption of the metal fitting manufacturing method according to the present invention.

C-2. Second Modified Example

Although the tool engagement portion 51 of the metal fitting 50 is substantially regular hexagonal in cross section in the above embodiment, the tool engagement portion 51 is not limited to such a cross-sectional shape. The cross-sectional shape of the tool engagement portion 51 may alternatively be formed in a regular n-sided polygonal shape (where n is a natural number of 3 or greater) other than the regular hexagonal shape, a n-sided polygonal shape other than the regular n-sided polygonal shape, a Bi-HEX shape (modified dodecagonal shape) (according to ISO 22977: 2005(E)) or the like. In the case where the cross-sectional shape of the tool engagement portion is a n-sided polygonal shape other than the regular n-sided polygonal shape, the tool engagement portion is formed such that the maximum opposite side dimension (longest opposite side length) of the tool engagement portion is larger than the outer diameter of the body portion, or the maximum diagonal dimension (longest diagonal length) of the tool engagement portion is larger than the outer diameter of the body portion, in the metal fitting manufacturing method according to the above embodiment. FIG. 10 is a plan view of a tool engagement portion of a metal fitting according to a modified embodiment of the present invention. In this modified embodiment, the tool engagement portion 51A of the metal fitting 50A has a Bi-HEX (modified dodecagonal) cross-sectional shape. As shown in the figure, a distance L1 between opposite sides of the tool engagement portion 51A is defined as an opposite side dimension; and a distance L2 between diagonally opposite corners of the tool engagement portion 51A is defined as a diagonal dimension. To manufacture the metal fitting with such a tool engagement portion 51A, the tool engagement portion 51A is formed such that the outer dimension of the body portion is smaller than the diagonal dimension of the tool engagement portion.

C-3. Third Modified Example

It is feasible to form the tool engagement portion by drawing the entire butt portion although the tool engagement portion is formed by drawing a part of the butt portion in the axis direction in the above embodiment. In the case where the tool engagement portion is formed by drawing the entire butt portion 510 in the fourth step of the cold forging process in the metal fitting manufacturing method according to the first embodiment, for example, the compression deformation portion 55 may be formed by cutting a rear end region of the body portion 502 or by cutting a front end region of the tool engagement portion. It is possible even in this case to obtain the same effects as in the above embodiment.

C-4. Fourth Modified Example

In the above first embodiment, the outer dimension of the body portion 502 of the semi-finished product 500B is set equal to the outer diameter of the seal portion 54 of the finished metal fitting 50 (that is, in the metal fitting manufacturing method according to the first embodiment, the outer diameter of the seal portion 54 of the finished metal fitting 50 is set equal to the outer dimension of the body portion 502 of the semi-finished product 500B). The semi-finished product is not however limited to such a configuration. For example, it is feasible to set the outer diameter of the body portion of the semi-finished product larger than the outer diameter of the seal portion 54 of the finished metal fitting 50 and form the seal portion 54 formed by cutting. It is alternatively feasible to set the outer diameter of the butt portion of the semi-finished product equal to the outer diameter of the crimp portion of the finished metal fitting such that the outer diameter of a part of the butt portion remains the same in the finished metal fitting for reduction of cutting workload.

C-5. Fifth Modified Example

Although the above embodiment refers to the metal fitting for use in the spark plug, the metal fitting is not limited to such use. The present invention is applicable to various metal fittings with tool engagement portions for use in sensors e.g. temperature sensors and any other devices. The present invention is also applicable to a manufacturing method of a sensor using such a sensor metal fitting.

C-6. Sixth Modified Example

In the above embodiment, the body and butt portions are formed in a substantially cylindrical column shape. The shapes of the body and butt portions are not limited to the substantially cylindrical column shape. The body and butt portions may alternatively be formed into a hexagonal shape, modified dodecagonal shape or other shape.

DESCRIPTION OF REFERENCE NUMERALS

5: Gasket
6: Ring member
8: Plate packing
9: Talc
10: Insulator
12: Axial hole
15: Reduced diameter portion
20: Center electrode
21: Cover material
25: Core material
30: Ground electrode
40: Metal terminal
50, 50A: Metal fitting
50B: Semi-finished cutting product
51, 51A: Tool engagement portion
52: Thread portion
53: Crimp portion
54: Seal portion
55: Compression deformation portion
56: Step portion
59: Through hole
100: Spark plug
500A to 500E: Semi-finished product
501: Pre-body portion
502: Body portion
504: Leg portion
506: First hole
508: Second hole
510: Butt portion
510*u*: First end
512: Pre-crimp portion
514: Tool engagement portion
516: Through hole Having described the invention, the following is claimed:

1. A manufacturing method of a metal fitting, the metal fitting comprising a tool engagement portion engageable with a tool, the manufacturing method comprising a cold forging process, wherein the cold forging process includes:

a step (a) of forming a body portion, a butt portion and a leg portion, the body portion having a first maximum length, the butt portion being continuous to the body portion and having a second maximum length larger than the first maximum length, the leg portion being continuous to the body portion and having an outer diameter smaller than the first maximum length; and a step (b) of drawing at least a part of the butt portion in an axis direction of the metal fitting, thereby forming the tool engagement portion.

2. The manufacturing method of the metal fitting according to claim 1, further comprising a cutting process of cutting at least a part of the butt portion, wherein, in the step (b), the tool engagement portion is formed on a region of the butt portion including a first end thereof not adjacent to the body portion.

3. The manufacturing method of the metal fitting according to claim 1, further comprising a cutting step of cutting at least a part of the butt portion, wherein, in the step (b), the tool engagement portion is formed on a region of the butt portion including a second end thereof adjacent to the body portion such that a maximum cross-sectional diagonal dimension of the tool engagement portion is larger than the first maximum length of the body portion.

4. The manufacturing method of the metal fitting according to claim 1, further comprising a cutting step of cutting at least a part of the butt portion, wherein, in the step (b), the tool engagement portion is formed such that a maximum cross-sectional diagonal dimension of the tool engagement portion is larger than the first maximum length of the body portion.

5. The manufacturing method of the metal fitting according to claim 1, wherein at least parts of the body and butt portions of the metal fitting manufactured by the manufacturing method have the same maximum lengths as those of the body and butt portions formed in the step (a).

6. A manufacturing method of a spark plug, comprising: obtaining a metal fitting by the manufacturing method according to claim 1.

7. A manufacturing method of a sensor, comprising: obtaining a metal fitting by the manufacturing method according to claim 1.

* * * * *